US007199755B2

(12) United States Patent
Belhora

(10) Patent No.: US 7,199,755 B2
(45) Date of Patent: Apr. 3, 2007

(54) COMPACT ANTENNA BLOCK FOR A WIRELESS DEVICE

(75) Inventor: Abdelkrim Belhora, Crosnes (FR)

(73) Assignee: FCI, Versailles (FR)

( * ) Notice: Subject to any disclaimer, the term of this patent is extended or adjusted under 35 U.S.C. 154(b) by 396 days.

(21) Appl. No.: 10/475,598

(22) PCT Filed: Apr. 16, 2002

(86) PCT No.: PCT/FR02/01311

§ 371 (c)(1),
(2), (4) Date: Mar. 19, 2004

(87) PCT Pub. No.: WO02/087015

PCT Pub. Date: Oct. 31, 2002

(65) Prior Publication Data

US 2004/0147288 A1 Jul. 29, 2004

(30) Foreign Application Priority Data

Apr. 23, 2001 (FR) ..... 01 05466
Apr. 23, 2001 (FR) ..... 01 05467

(51) Int. Cl.
*H01Q 1/38* (2006.01)

(52) U.S. Cl. ..... 343/700 MS; 343/846

(58) Field of Classification Search ..... 343/700 MS, 343/702, 846, 767, 795
See application file for complete search history.

(56) References Cited

U.S. PATENT DOCUMENTS 4,426,649 A * 1/1984 Dubost et al. ..... 343/700 MS
5,166,697 A * 11/1992 Viladevall et al. ..... 343/727
5,631,660 A * 5/1997 Higashiguchi et al. ..... 343/702
6,133,879 A 10/2000 Grangeat et al. .... 343/700 MS

FOREIGN PATENT DOCUMENTS

| | | |
|---|---|---|
| EP | 0762539 A1 | 3/1997 |
| EP | 0892459 A1 | 6/1998 |
| EP | 1024522 A2 | 8/2000 |
| WO | WO-98/44588 A1 | 10/1998 |
| WO | WO-01/24314 A1 | 4/2001 |

OTHER PUBLICATIONS

Naftali Herscovici, "New Considerations in the Design of Microstrip Antennas", XP-000766091, 1998 IEEE, pp. 807-812.

* cited by examiner

*Primary Examiner*—Michael C. Wimer
(74) *Attorney, Agent, or Firm*—Harrington & Smith, PC

(57) ABSTRACT

In order to create a compact antenna block a corner-shaped support is provided with a radiating area on an upper surface thereof and a transition area is provided on an underlying surface. The transition area is characterized in that it is triangular. The angle of the triangle forms a connection point for the antenna. The tapered part of the corner-shaped support is fitted with a pole enabling it to be lifted above the plane of the circuit to which the antenna block is connected, whereby the transition area extends gradually above said plane, the upper radiating area being substantially parallel to said plane. As a result the impedance of the antenna can be regulated more easily in such a way that it is continuously constant and the reflection coefficient is improved.

18 Claims, 2 Drawing Sheets

COMPACT ANTENNA BLOCK FOR A WIRELESS DEVICE

FIELD OF INVENTION

The subject of the present invention is a particularly compact antenna block for a wireless device, notably for a mobile telephone. The subject of the invention also is wireless devices for information networks, notably by transmission according to the Blue Tooth standard. The antenna block of the invention is designed to be used with one or the other of the involved frequencies, or even one and then the other successively. The invention principally seeks to simplify the creation of radiating devices, antenna blocks, while conferring broader-spectrum performance and a better adaptability to the medium in which these devices must radiate.

BACKGROUND OF THE INVENTION

In the mobile telephone field, particularly in Europe, the GSM standard at 900 MHz and the DCS standard at 1800 MHz are known. The frequency bands at which a mobile telephone must radiate, both in transmission and reception, are thus clearly distinct. Moreover, for third-generation mobile telephones, in addition to the PCS standard at 2100 MHz, there is also the UMTS standard at 2200 MHz. In the course of manufacture, mobile telephones must therefore now have available a radiating element, if possible a single one, capable of radiating in these three distinct frequency bands. In passing, it will be noted that the latter bands (1800 MHz to 2200 MHz) form a broad band, in particular by encompassing the DECT standard of 1800 MHz to 1900 MHz.

For complete interactivity of wireless devices, the necessity of satisfying the Blue Tooth standard or the IEEE802.11 standard is now added to the complexity of creating an antenna capable of these three frequency bands. To obtain such a variety of frequencies with a single aerial antenna is a problem that is currently unresolved. We therefore turn to multiple antenna structures.

An antenna permitting radiating in two bands, typically the GSM band at 900 MHz and the DCS band at 1800 MHz, is known from the document of the prior art "Dual-Frequency Planar Inverted-F Antenna", of Zi Dong Liu and Peter S. Hall in "IEEE Transactions on antennas and propagation," Vol. 45, No. 10, October 1997, pages 1451 and following. The geometry of the antenna, which is particularly simple and which is envisioned for such a situation of radiation over two bands, has a metallized zone in the shape of the letter L overall and a rectangular metallized area able to be positioned in the open space of the L shape. On the one hand, this solution has separate feeds for the different antenna elements so that switching circuits must be added to the electronic circuit to which this antenna is coupled. These switching elements themselves create operating difficulties. On the other hand, high bands such as UMTS and very high bands such as Blue Tooth are not possible with such a network.

Such solutions are therefore poor. They require connection switches, which generate problems for transmission or reception.

SUMMARY OF THE INVENTION

In the present invention, in order to remedy this problem, the creation of an antenna whose radiating part is formed by a flat metallized radiating layer is envisioned. The flat radiating layer has different patterns that form the surface radiating networks. These networks permit an amplification by adaptation of the length of conductive tracks which result from the patterns at the wavelength of the electromagnetic waves to be radiated by the antenna. In the invention, one can thus envision, for one example, an asymmetric H-shaped pattern, meaning that the insulating zones forming the legs of the H bound and define the conductive tracks. These legs are not symmetrically arranged relative to the horizontal insulating bar of the H. In this way, the offset would permit broadening the band around the frequencies considered, notably around 2400 MHz.

In a complementary manner, a good result can also be obtained by creating a radiating element with two insulating slots by another pattern and placing this radiating element with two slots between the asymmetric H pattern, on one side, and a principal radiating element, essentially a conductive strip, on the other side. In this case, it could be observed that a mutual controlled influence could be established between the radiating zones of the first pattern and those of the second pattern. This influence then modifies the frequency characteristic of the antenna in a very significant way by broadening the intermediate frequency band. This broadening of the band is used in the invention to comply with the frequency band corresponding to the DCS, PCS, UMTS, or even DECT standards.

Providing an antenna having a radiating microband in the form of a flat metallized layer, placed in an elevated position relative to a circuit which bears it, notably a circuit provided with a continuous metal surface forming a ground plane, is known particularly, from the document "*New Considerations in the Design of Microstrip Antennas*" of Naftali Herscovici, "*IEEE Transactions on antennas and propagation*," Vol. 46, No. 6, June 1998, pages 807 and following. The antenna pattern is connected to the circuit here by means of a transition connection between the circuit and the metallization of the antenna pattern. This transition connection is present in the form of a conductive part raised above the circuit support. However, the embodiment thus recommended does not benefit from a sufficient degree of freedom to also take into account a radiation parameter, in a supplemental manner. This radiation parameter to take into consideration is the impedance adaptation of the antenna to the medium in which it is supposed to radiate.

In fact, this antenna must be adapted to the impedance of air and, moreover, must take into account penalizing circumstances, such as the proximity or lack of proximity of the hand or the head of a mobile telephone user, or the proximity of other structures, notably metal ones. It is clear from the different possibilities for use of a mobile telephone that this impedance must be adaptable. It is particularly important to minimize losses in the transition zone between the waveguide means, electrically linked to the outlet of the electronic transmission and reception circuit, and the radiating element of the antenna.

In addition, another problem is posed, that of miniaturization. Such miniaturization limits foreseeable technical solutions.

The invention thus seeks to create a broadband multifrequency antenna. The interest of having broad bands is to preserve a large antenna gain even in the presence of disruptive elements such as metal structures that shift the tuning frequency of the antenna. Moreover, the invention seeks to minimize losses at the level of the transition between the waveguide means and a radiating or receiving element.

DETAILED DESCRIPTION OF THE INVENTION

In the invention, this is obtained by creating a progressive transition zone between these two parts. The progressive transition zone is a continuous transition zone minimizing losses by reflection and permitting a broadband functioning of the antenna. The transition zone preferably has a length equivalent to the length of the radiating zone. Their difference is due to an incline.

Thus, this problem is remedied in the invention by creating an antenna having a radiating zone and a transition zone, the transition zone being positioned under the radiating zone. It could thus be shown that by acting in this way, a greater transition zone is available, since it can practically occupy the same length as an antenna that it is supposed to connect.

According to the solution of the invention, the metallization of a radiating zone and of a transition zone, leading to an electronic circuit at the radiating zone, is formed by a layer, preferably metallized, borne by the same support (but on the bottom) as that which bears the radiating layer. A great ease of manufacture, transport and positioning of the antenna results from this, in addition to the solution to the problems stated above of band width and impedance adaptability.

The subject of the invention is therefore an antenna block for a wireless device, comprising a radiating zone and a transition zone, the transition zone serving to connect the radiating zone to an electronic transmitter and/or receiver circuit of the wireless device, the radiating zone comprising a first metal layer, characterized in that the transition zone has a second metal layer, and in that the two layers are superimposed and connected together electrically by a metal reversal piece.

BRIEF DESCRIPTION OF THE DRAWING

The invention will be better understood upon reading the description that follows and examining the figures that accompany it. These figures are only shown by way of indication and do not at all limit the invention. The figures show.

DETAILED DESCRIPTION OF THE INVENTION

Figure 1A:
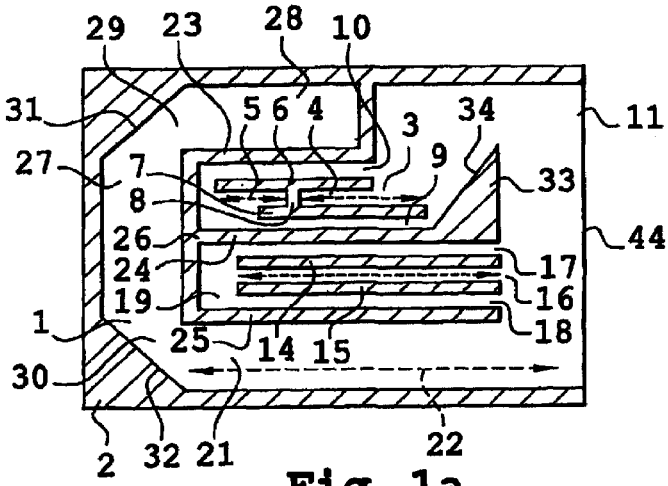
FIGS. 1*a* to 1*d*: an example of embodiment of an antenna pattern according to one aspect of the invention.

FIG. 1*a* shows an antenna block for a mobile telephone. For example, this antenna block has a metallization [conducting layer] 1 borne by a support 2, for example of plastic or ceramics. Radiating zone 1 can thus be obtained by deposition, notably metal vapor deposition, then etching of the metallized layer in order to create patterns favoring resonance in this metallized zone, and therefore favoring transmission or reception of certain spectral components. The spectral components are precisely those mentioned above.

Figure 1B:
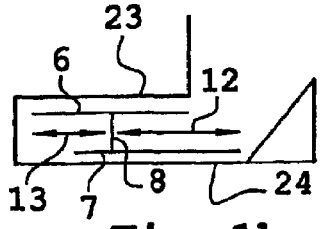

For this purpose, radiating zone 1 has a first pattern 3 in the shape of an asymmetric H. This pattern is also shown in FIG. 1*b*. In this pattern 3, a metallized strip 4 is aligned with, but separated from another metallized strip 5. The two strips 4 and 5 are bordered on either side by two etched slots 6 and 7. The two etched slots, of roughly equal length, are connected by an etched bridge 8 permitting the two strips 4 and 5 to face each other. The two slots 6 and 7 and bridge 8 form insulating zones. Moreover, electrically, the two strips 4 and 5 are fed by two conduction channels 9 and 10 situated on the other side of the strips, respectively, relative to etched slots 6 and 7. The conduction channels end at a base 11 for connection of the antenna. The offsetting of slots 6 and 7 is such that slot 7 is overall closer to base 11 than slot 6 is. The two strips 4 and 5 also have different lengths, 12 and 13, respectively, corresponding to the wavelengths of the waves to be radiated by the antenna.

It can be shown that this off-setting of the slots and also the difference in lengths 12 and 13 can lead to a broadening of the first very-high-frequency pass-band, notably for the radiating band corresponding to the Blue Tooth standard.

Figure 1C:
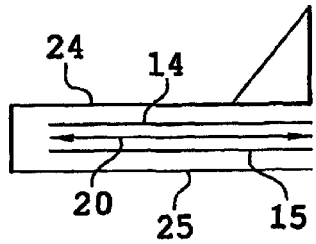

Metallization 1 forming the antenna also has a second pattern, also shown by itself in FIG. 1*c*. This pattern is formed of two insulating etched slots 14 and 15 together creating a strip 16 between them and, on either side, two conduction channels 17 and 18, all three having their source in base 11. Channels 17 and 18 and strip 16 are connected together at their top by an electric bridge. The two slots 14 and 15 permit defining a second length 20 corresponding to an average wavelength of a second resonance pass-band.

Figure 1D:
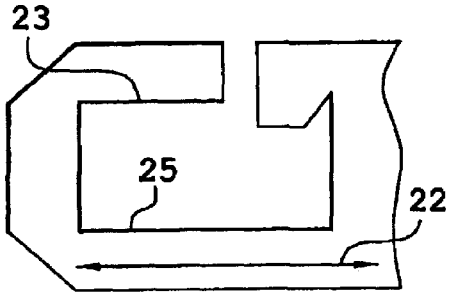

Antenna 1 finally has a third pattern created principally by a broad band 21 whose length 22 permits defining a third average wavelength of a third resonance band of the antenna. FIG. 1*d* shows the third individual pattern.

In fact, the three metallization patterns are connected together by base 11, but are separated from one another by insulating zones. These insulating zones fundamentally comprise three arms 23, 24 and 25, respectively, together emerging into an insulating arm 26. The second pattern 14–20 is thus contained between arms 24 and 25, between the first pattern 3–13 and the second pattern of the band 21–22.

The large band 21 is also continued, on the side opposite base 11, by a connection 27 perpendicular to band 21. Connection 27 is itself continued by a half-band 28 (of the quarter-wave type). Bands 21, 27 and 28 are linked by connection zones 29 and 30 both comprising the particular feature of having a cut section 31 and 32, respectively. Cut sections 31 and 32 permit transporting the signal by preventing reflections that can damp signal transmission. It could be determined that these cut sections promoted a gain of antenna 1 in the low-frequency band.

The interlacing of the patterns thus created is also of a nature to favor a broadening of the pass-band of the second pass-band by coupling with the second pattern. The proximity of the asymmetric H pattern and the second double-slot pattern thus induces a broadening of the second resonance pass-band.

In the same way, insulation arm 24 situated between the first and the second pattern has an insulating zone 33 in the region of base 11 in the form of a triangle extending in the direction of the first asymmetric H pattern, away from the second pattern of double slots 14 and 15. In the same way, triangle 33 has a cut section 34 favorable to the attenuation of reflections as well as a means for controlled coupling of the radiation induced by the second pattern to the radiation induced by the first pattern.

Figure 2:
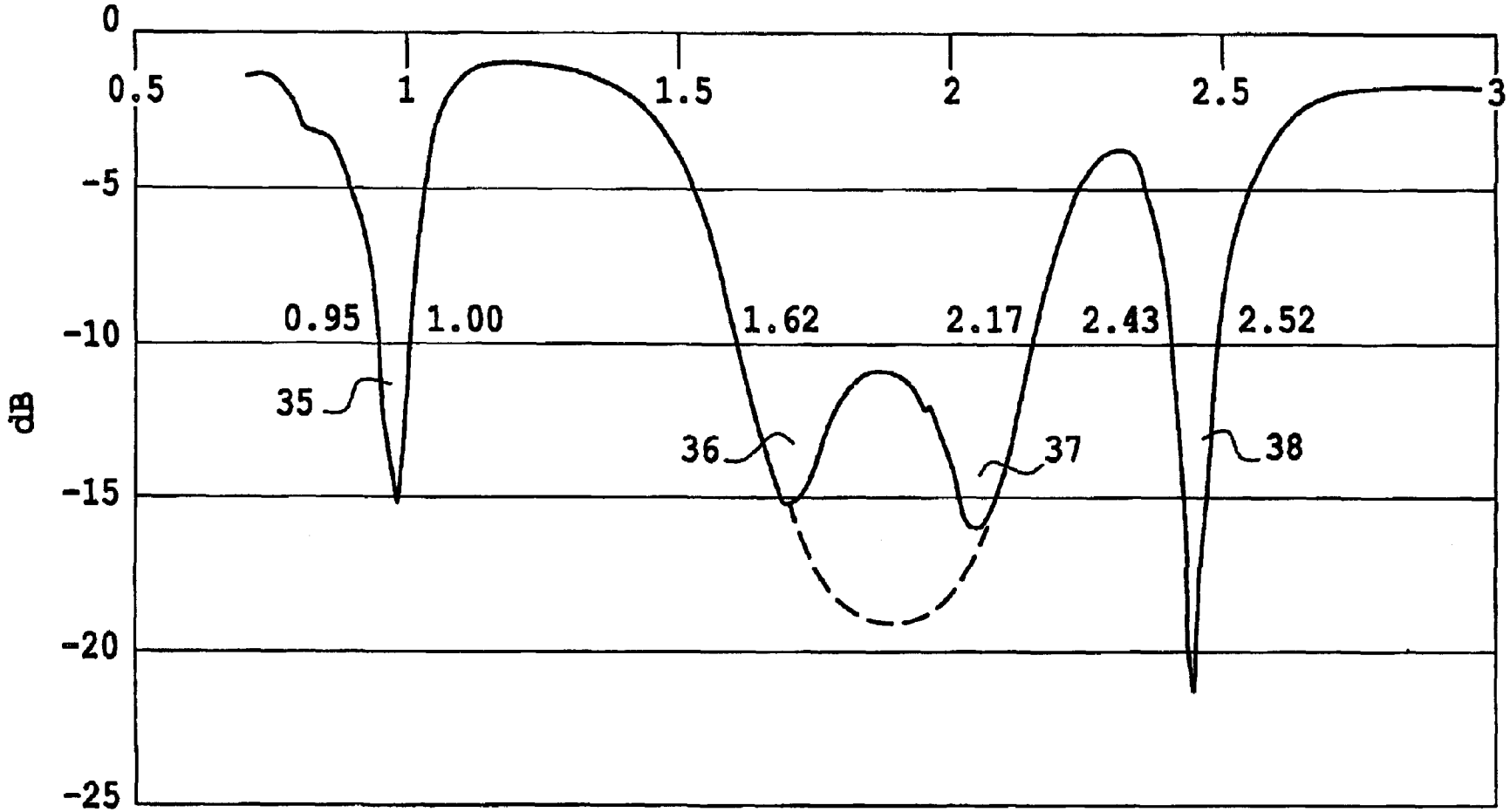
FIG. 2: a spectral diagram of the measurements carried out with the antenna of FIGS. 1*a* to 1*d* showing the ratio of energy reflected by the antenna to energy transmitted by the latter.

FIG. 2 shows a result of measurement of the ratio value of the signal reflected by the antenna to the signal transmitted by the antenna. The peaks represented definitively show the frequencies in which the antenna resonates correctly. FIG. 2 thus shows a first peak 35 corresponding to frequencies of the GSM 900 MHz type. It also has second and third peaks 36 and 37 due to the presence of the second pattern, as well as the coupling with strip 4 of the first pattern. Finally, the diagram of FIG. 2 shows a fourth peak 38 corresponding to the Blue Tooth standard and induced by strip 5. It will be noted that the two peaks 36 and 37 are connected by a broad band (with rejection and reflection levels of less than −10 dB) permitting functioning of the antenna with an acceptable gain in all the intermediate bands mentioned above.

The fact of having placed the radiating element with two slots between the asymmetric H element on one side and the principal radiating element on the other side modifies the frequency characteristic of this element by significantly broadening the frequency band.

In one example, antenna 1 has dimensions of 3.5 cm long by 2.5 cm wide.

Figure 3A:
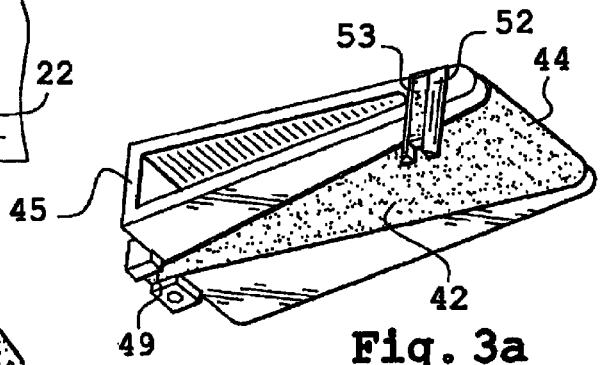
FIGS. 3*a* and 3*b*: bottom and top views, respectively, in perspective of an antenna block according to one aspect of the invention.
Figure 3B:
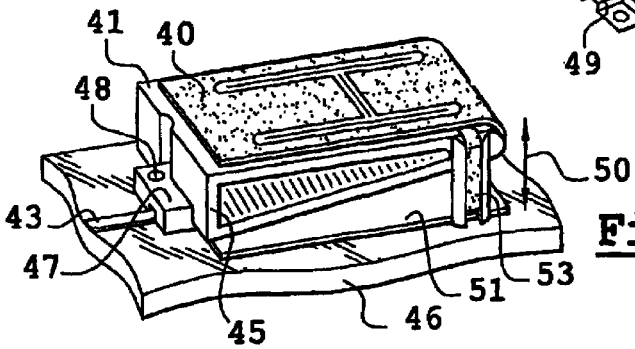

FIG. 3*a* and FIG. 3*b* show, conforming to one subject of the invention, a preferred coupling circuit for an antenna in a mobile telephone. FIG. 3*a* is a view of the antenna from the bottom of its radiating face. FIG. 3*b* is a perspective view of the same antenna viewed from the top, with the radiating zone visible. The radiating pattern shown on the radiating zone is a particular case. The antenna block for a mobile telephone thus embodied has a metallized and flat radiating zone 40. Possibly, zone 40 could be made in the form of a metal plate. In practice, metallized zone 40 is borne by a support 41 of plastic or ceramics. Making it of ceramics could permit making a smaller support due to the difference in the dielectric constant of the material. Radiating zone 40 is coupled to a transition zone 42, FIG. 3*a*, also preferably borne by support 41. In one example, the two zones are metallizations, notably created by MID technology, then finally etched. The pattern of metallization area 40 is preferably that of FIG. 1*a*.

Transition zone 42 serves to connect zone 40 to an electronic transmitter and/or receiver circuit of a mobile telephone (not shown) and accessible by a connection 43. Antenna block 40–42 has the particular feature that both layers 40 and 42 are superimposed overall and electrically joined together by a metal (or metallized) reversal piece. The fact of supporting metallizations areas 40 and 42 and reversal piece 44 on the same support 41 confers a great reproducibility to the mounting of the antenna and its behavior once mounted. The superimposition of the invention thus permits having a long transition zone, for example, longer than the radiating zone, which is favorable to a better impedance adaptation. The superimposition is such that, for example, the incline of the transition zone on the electronic circuit, or under the radiating zone, is of the order of or less than 30 degrees of angle, in any case less than 45 degrees. Due to the fact of this superimposition, the transition layer is sandwiched between the electronic circuit and the radiating zone. With the superimposition, the transition zone does not occupy any additional space above the electronic circuit.

For example, very simply, one end of support 41, in the place where reversal piece 44 is designed to be positioned has a finer rounded edge in order to make the two surfaces communicate with each other, the one bearing metallization area 40 and the one bearing metallization area 42. In this case, this rounded edge forms a reversal piece permitting assuring to a metallization area 44 continuity between a transition zone 42 and a radiating zone 40. The fact of making zone 42 subjacent to zone 41 permits having a significant length available for zone 42, for example, and preferably the length of zone 40. This length is measured in the direction of propagation of the signal to be radiated, from connection 43 to zone 40. In this case, it is possible to adopt a gentle progression of width for zone 42, between a width at the place for joining to connection 43 and a width at the location of reversal piece 44, equal to the width of the radiating zone. In this way, with progressive broadening, a better capability is shown for adapting the impedance to an impedance to be obtained. Reversal piece 44 is also shown as ending up at base 11 of the antenna of FIG. 1*a*.

Support 41, moreover, has the particular feature that it has the shape of a corner overall. The corner has a shape pointing to the place of reversal piece 44. At the other end, support 41 has a right foot 45 designed to be raised roughly perpendicular to a circuit 46 on which the antenna block will be mounted. Circuit 46 notably bears connection 43. For this purpose, right foot 45 is provided with a console 47 itself pierced with an opening 48 for engaging a screw for holding antenna block 40–45 onto circuit 46. The bond between transition zone 42 and connection 43, for example, can be made by a solder bead placed between this track and a beginning part 49 of zone 42 at the place of console 47. This solder bead is then melted during connection. The corner shape of support 41 thus confers to transition zone 42 the particular feature of being progressively raised above the plane of circuit 46. This progressive elevation, as well as the overall triangular shape of transition zone 42 and height 50 above circuit 46 where radiating zone 40 is situated also have parameters that permit adapting the impedance of the antenna, particularly taking into account the conditions of use invoked above.

The width of the transition zone thus increases the width of connection 43 until the width of base 11 of the radiating zone is reached. The increasing function is a linear function, varying with the length of zone 42 and with the height 50 of the transition zone. In this way, a constant impedance of the connection in all sections of zone 42 is obtained. The width of a section at each place of zone 42 is calculated principally as a function of the height of this section relative to the ground plane, for the desired impedance.

Due to the use of a progressive transition, it was possible to use the antenna in broadband mode by making cut-outs creating segments tuned to the frequencies considered on surface 40 of the antenna.

In a preferred case, circuit 46 bears a ground plane 51 on which the antenna block 40–45 is placed. In the case where ground plane 51 is present, on one hand, the length of the radiating element must be close to a quarter of the minimal wavelength to be transmitted and/or received, or if there is no ground plane 51, it must be close to a half-wavelength. Moreover, in a way notably to assure the stability of mounting of support 51, the latter may be provided with a pole 52 situated near the edge of reversal piece 44. This pole 52 can also serve to electrically couple reversal piece 44 (and also base 11) to ground plane 51. For this purpose, pole 52 can have a metallization area 53 communicating with radiating zone 40. Possibly a second pole can be envisioned for the other side of support 41.

Figure 4:
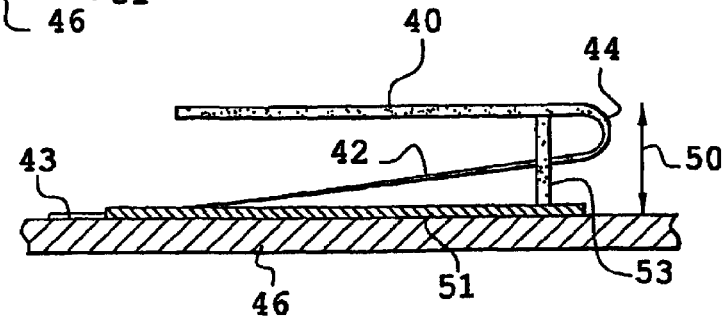
FIG. 4: a sectional view of the radiating and transition zones, the active zone of the antenna of FIGS. 3*a* and 3*b*.

FIG. 4 shows the overall appearance of the metallization areas borne by support 45 in the form of a corner. For example, the curve of metallization area 44 has a radius roughly equal to a third of height 50. In a preferred example, this height 50 is equal to 0.8 cm.

The invention claimed is:

1. An antenna block for a wireless device having a radiating zone and a transition zone, the transition zone serving to connect the radiating zone to an electronic transmitter and/or receiver circuit of the wireless device at a connection end, the radiating zone having a first metal layer, characterized in that the transition zone has a second metal layer, and in that the two layers are superimposed and electrically coupled together by a metal reversal piece and in that the transition zone has a metallization whose width progressively and continuously widens from the connection end up to the width of the radiating layer.

2. The block according to claim 1, further characterized in that the transition zone has a metallized layer borne by a support, this metallized layer being inclined and progressively rising above a plane of a circuit connected to the electronic transmitter and/or receiver circuit.

3. The block according to claim 1, further characterized in that the same support bears a metallized layer serving as the radiating layer.

4. The block according to claim 1, further characterized in that the radiating zone is deployed above a ground plane.

5. The block according to claim 4, further characterized in that the radiating zone is situated above the ground plane at a height that is a function of the desired impedance of the antenna.

6. The block according to claim 1, further characterized in that the radiating zone has a length of the same order as the length of the transition zone.

7. The block according to claim 1, further characterized in that the radiating zone has a lateral grounding, situated preferably in a retainer piece of a support that bears it.

8. The block according to claim 1, further characterized in that the radiating zone has a length close to a quarter or a half of the wavelength of a radiated electromagnetic wave according to whether or not it is situated above a ground plane.

9. The block according to claim 1, further characterized in that the radiating zones and the transition zone are borne by a ceramic support.

10. The block according to claim 1, further characterized in that the radiating zones and the transition zone are borne by a plastic support.

11. The block according to claim 1, further characterized in that the radiating zone and the transition zone are borne by a ceramic support.

12. The block according to claim 1, further characterized in that the radiating zone is flat and has a first asymmetric-H pattern to correspond to a first pass-band of the antenna.

13. The block according to claim 1, further characterized in that the radiating zone has three interlaced patterns to form three different pass-bands of the antenna.

14. The block according to claim 12, further characterized in that the radiating zone has a second pattern in the form of two slots to correspond to a second pass-band of the antenna.

15. The block according to claim 12, further characterized in that the radiating zone has a third pattern in the form of a band to correspond to a third pass-band of the antenna.

16. The block according to claim 12, further characterized in that the second pattern that corresponds to the second pass-band is situated between the first asymmetric H-shaped pattern that corresponds to the first pass band and the third band pattern that corresponds to the third pass-band.

17. The block according to claim 16, further characterized in that the radiating zone has a zone free of metallization to serve for uncoupling the radiation between the first and second patterns.

18. The block according to claim 1, further characterized in that the radiating zone has dimensions of 3.5 cm by 2.5 cm and has means for being situated 0.8 cm above a ground plane.

* * * * *